US007392751B2

(12) United States Patent
Bergmyren

(10) Patent No.: US 7,392,751 B2
(45) Date of Patent: Jul. 1, 2008

(54) PORT RODDER WITH VELOCITY DAMPER

(75) Inventor: Leif Bergmyren, Hagerstein (SE)

(73) Assignee: Diamond Power International, Inc., Lancaster, OH (US)

( * ) Notice: Subject to any disclaimer, the term of this patent is extended or adjusted under 35 U.S.C. 154(b) by 0 days.

(21) Appl. No.: 11/138,574

(22) Filed: May 26, 2005

(65) Prior Publication Data

US 2005/0263047 A1 Dec. 1, 2005

Related U.S. Application Data

(60) Provisional application No. 60/575,633, filed on May 28, 2004.

(51) Int. Cl.
*F22B 37/10* (2006.01)

(52) U.S. Cl. ..... 110/182.5; 122/235.13; 122/379

(58) Field of Classification Search ..... 110/182.5, 110/147, 163, 297, 314, 219; 431/188; 122/235.13
See application file for complete search history.

(56) References Cited

U.S. PATENT DOCUMENTS 4,099,471 A 7/1978 Sander et al.
4,545,308 A 10/1985 Zaterka
4,653,409 A 3/1987 Eriksson
4,823,710 A 4/1989 Garrido et al.
4,838,182 A 6/1989 Goodspeed
4,846,080 A 7/1989 Ross et al.
5,001,992 A 3/1991 Higgins et al.
5,007,354 A 4/1991 Uppstu
5,022,331 A 6/1991 Simonen
5,305,698 A 4/1994 Blackwell et al.
5,528,999 A * 6/1996 Salmi ..... 110/182.5
5,824,275 A 10/1998 Bitzer et al.
6,006,683 A 12/1999 Janka et al.
6,186,080 B1 2/2001 Hino et al.
6,257,156 B1 7/2001 Kaulamo
6,279,495 B1 8/2001 Karidio et al.
6,311,630 B1 11/2001 Vanhatalo
6,431,125 B1 8/2002 Eriksson
6,579,091 B1 6/2003 Simonen
6,672,227 B2 1/2004 Nordenberg

* cited by examiner

*Primary Examiner*—Kenneth B Rinehart
(74) *Attorney, Agent, or Firm*—Brinks Hofer Gilson & Lione

(57) ABSTRACT

A port rodder assembly for a recovery boiler includes a duct affixed to and in fluid communication with an air port of the boiler, having a hollow interior, and an air inlet opening. A cutting head is slidably mounted within the duct adjacent to the air port and is adapted to clean the air port. An actuator selectively advances the cutting head though the air port to clean the air port. A wing is pivotally mounted within the duct. The wing interacts with the air inlet opening to control the flow of air through the duct and into the air port and is shaped such that incoming air flows smoothly through the duct to the air port.

20 Claims, 8 Drawing Sheets

PORT RODDER WITH VELOCITY DAMPER

CROSS-REFERENCE TO RELATED PATENT APPLICATIONS

This patent application claims the benefit of U.S. provisional patent application 60/575,633, filed May 28, 2004.

FIELD OF THE INVENTION

The present invention relates to a device for cleaning an air port arranged in the wall of a furnace and for regulating the flow of air through the air port which may be used, for example, in a recovery boiler or furnace.

BACKGROUND OF THE INVENTION

Within the cellulose production industry, the spent liquors from paper wood boiling (sulfate spent liquor and, in some cases, sulfite spent liquor) are combusted in a recovery boiler. The nature of the fuel and the process conditions result in a tendency of plugging of the air ports, which are openings through which combustion air is supplied. This clogging occurs through an accumulation of dust particles and flowing cinder products within the boiler. These pluggings are more accentuated in the lower regions of the air port and especially at the bottom. There are numerous known arrangements of cleaning devices which reciprocate through the air port for cleaning which are activated periodically as needed. It is important from environmental and process control points of view to achieve as complete a combustion as possible of the spent liquor within the recovery boiler. The supplemental supply of air through the air ports is an important parameter to achieve this goal. In addition to cleaning the air port, it is desirable to provide a regulating device which allows modulation of the air flow rate through the air port to achieve desired boiler operating parameters.

There are numerous examples of so-called port rodder devices for cleaning air ports which include damper assemblies for regulating air flow. In many examples of the prior art, the air regulating device provides a sharp edge orifice of variable area through which the air flows. Such an orifice configuration produces highly turbulent air flow into the combustion device. Due to its turbulence, this air flow is not able to penetrate deeply into the boiler interior, and thus produces a stratification of the air flow and available oxygen within the boiler interior. An ideal device of this type would produce an air stream into the boiler which has a velocity which enables it to penetrate into the interior of the boiler to provide a more homogeneous supply of combustion oxygen within the boiler interior. Additional examples of prior art rodder devices incorporate damper assemblies which must be retracted to a fully opened position before a cleaning cycle for the air port may be achieved. Thus, in such systems, the precisely adjusted damper position set for providing desirable furnace operating parameters is upset during the cleaning cycle. This can produce undesirable transient operating conditions within the boiler.

SUMMARY OF THE INVENTION

A port rodder assembly in accordance with the present invention is positioned adjacent to an air port of a boiler and incorporates a reciprocating cutting head for periodically cleaning the air port to ensure that it is opened to permit air flow. A damper in the form of a pivoting wing is provided within the cassette assembly of the device which can be rotated between a fully opened configuration which maximizes air flow to a closed position which reduces the effective air flow area. The wing provides a streamline shape for interaction with the air flow to provide a penetrating, smooth air flow jet into the boiler through the air port. The assembly includes features which enable the cutting head to be reciprocated for cleaning without interference with the wing or requiring its position to be changed. In this way, cleaning operations produce a minimal change in air flow through the port rodder assembly.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION

Figure 1:
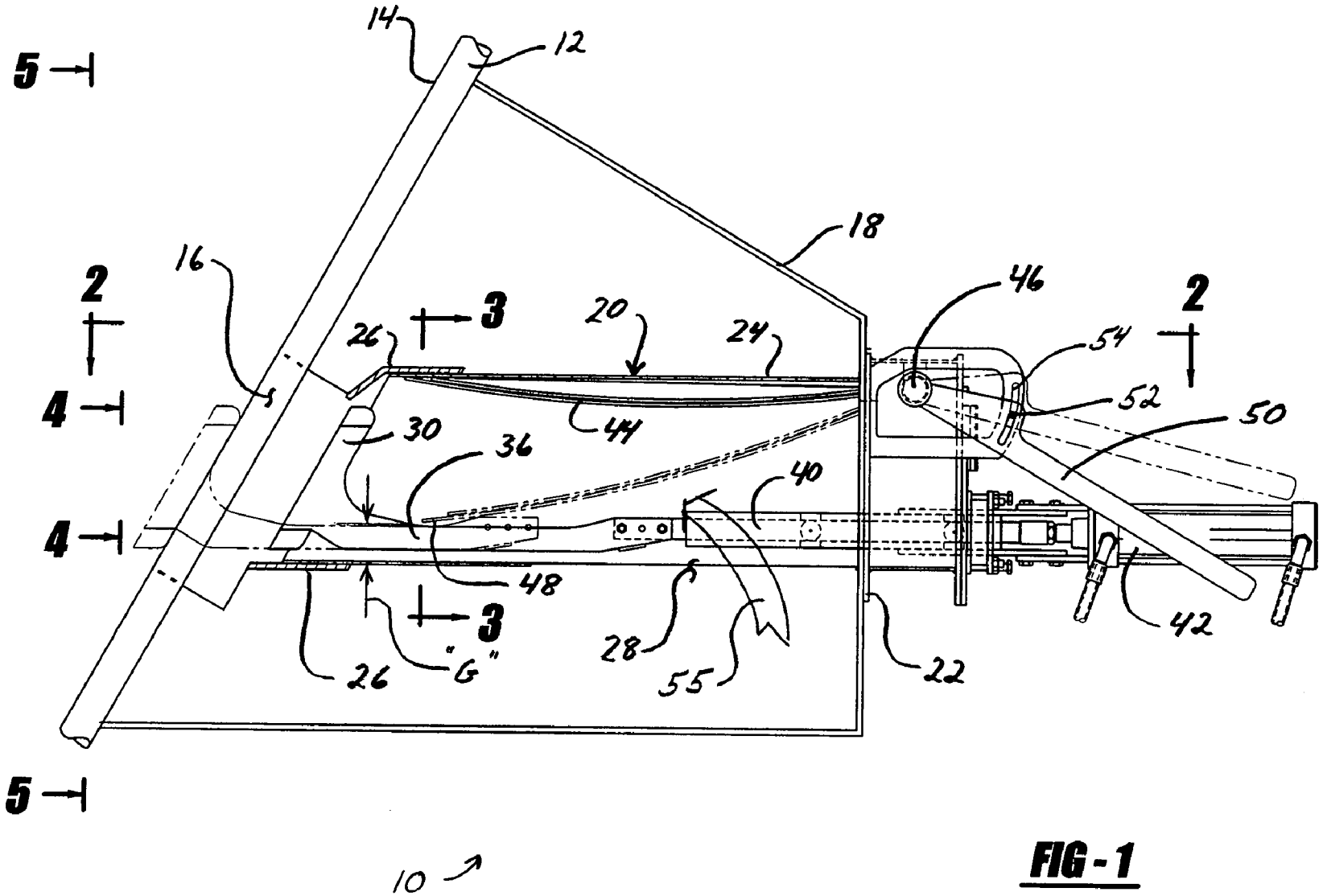
FIG. 1 is a side cut-away view of the port rodder assembly in accordance with this invention.
Figure 2:
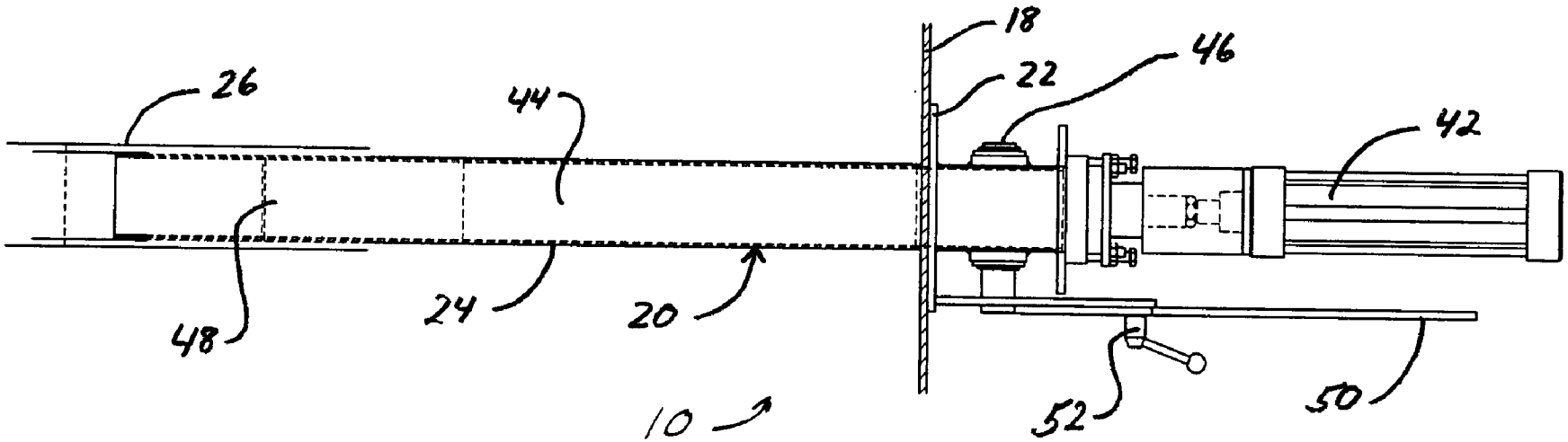
FIG. 2 is a cross-sectional view taken along line 2-2 of FIG. 1.

Referring to FIGS. 1-5, a port rodder assembly in accordance with the teachings herein is shown generally at 10. The port rodder assembly 10 is shown mounted to the exterior surface of a boiler outer wall 12. The outer wall incorporates boiler tubes 14 to conduct water or steam for removing heat from the combustion process occurring within the boiler. An air port 16 is formed within the boiler outer wall 12. The air port 16 defines a narrow rectangular slot which penetrates boiler wall 12 for the admission of combustion air, as previously described. A typical boiler will have a multiplicity of air ports 16, strategically arranged around the perimeter of the boiler to admit supplemental atmospheric air in desired quantities.

The port rodder assembly 10 is used with wind box 18 mounted to the exterior surface of the boiler outer wall 12. The wind box 18 is a sheet metal structure that is fastened to boiler wall 12 and provides support for the remaining components of the assembly 10. The wind box 18 encloses the air ports 16 and includes an opening to allow air to enter the wind box 18.

A cassette assembly 20 is mounted within the wind box 18 via a mounting flange 22. The cassette assembly 20 is inserted into an elongated duct 24. The duct 24 is formed of sheet metal and has a generally rectangular, hollow cross-section. One end of the duct 24 is connected to an adapter 26. The adapter 26 connects the end of the duct 24 to the air port 16.

The duct 24 has an air inlet opening 28 to allow air to flow into the duct 24 from the interior of the wind box 18.

Figure 3:
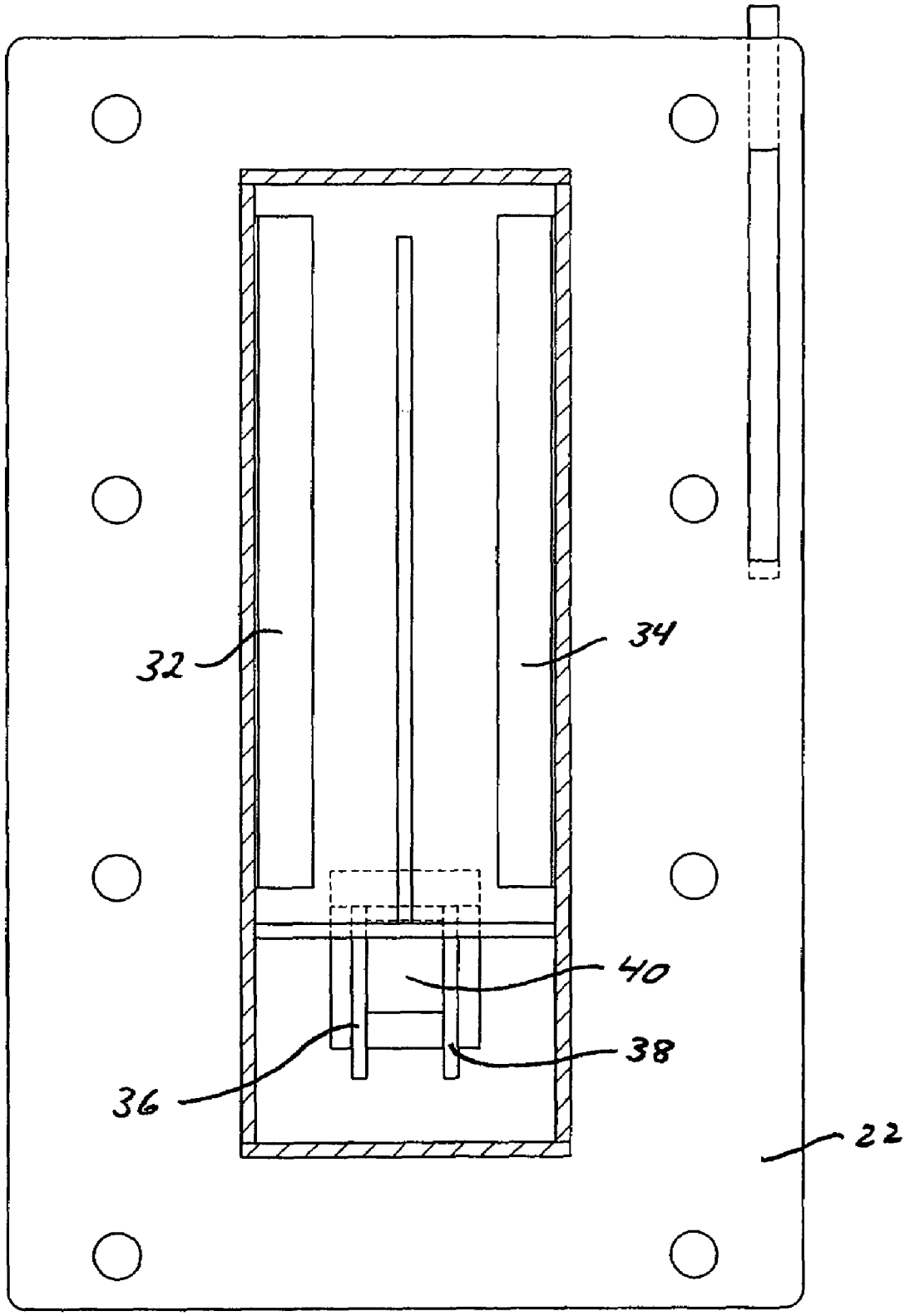
FIG. 3 is a cross-sectional view taken along line 3-3 of FIG. 1.
Figure 4:
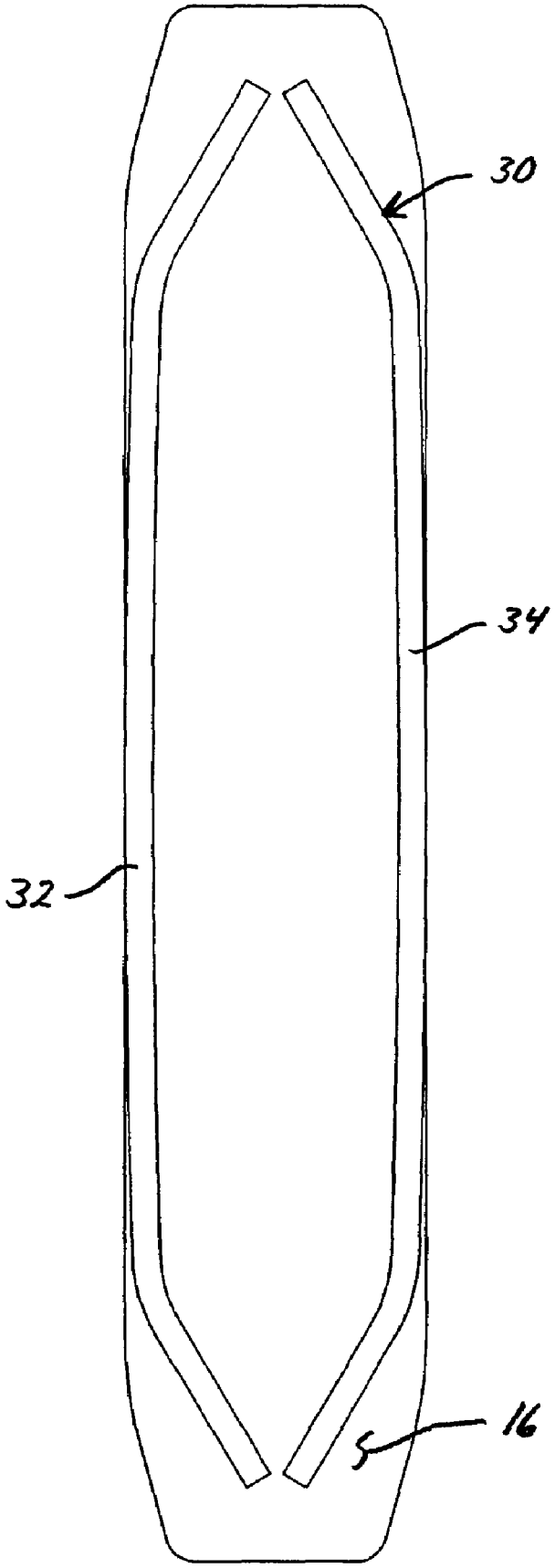
FIG. 4 is an end view taken in the direction of lines 4 of FIG. 1.
Figure 5:
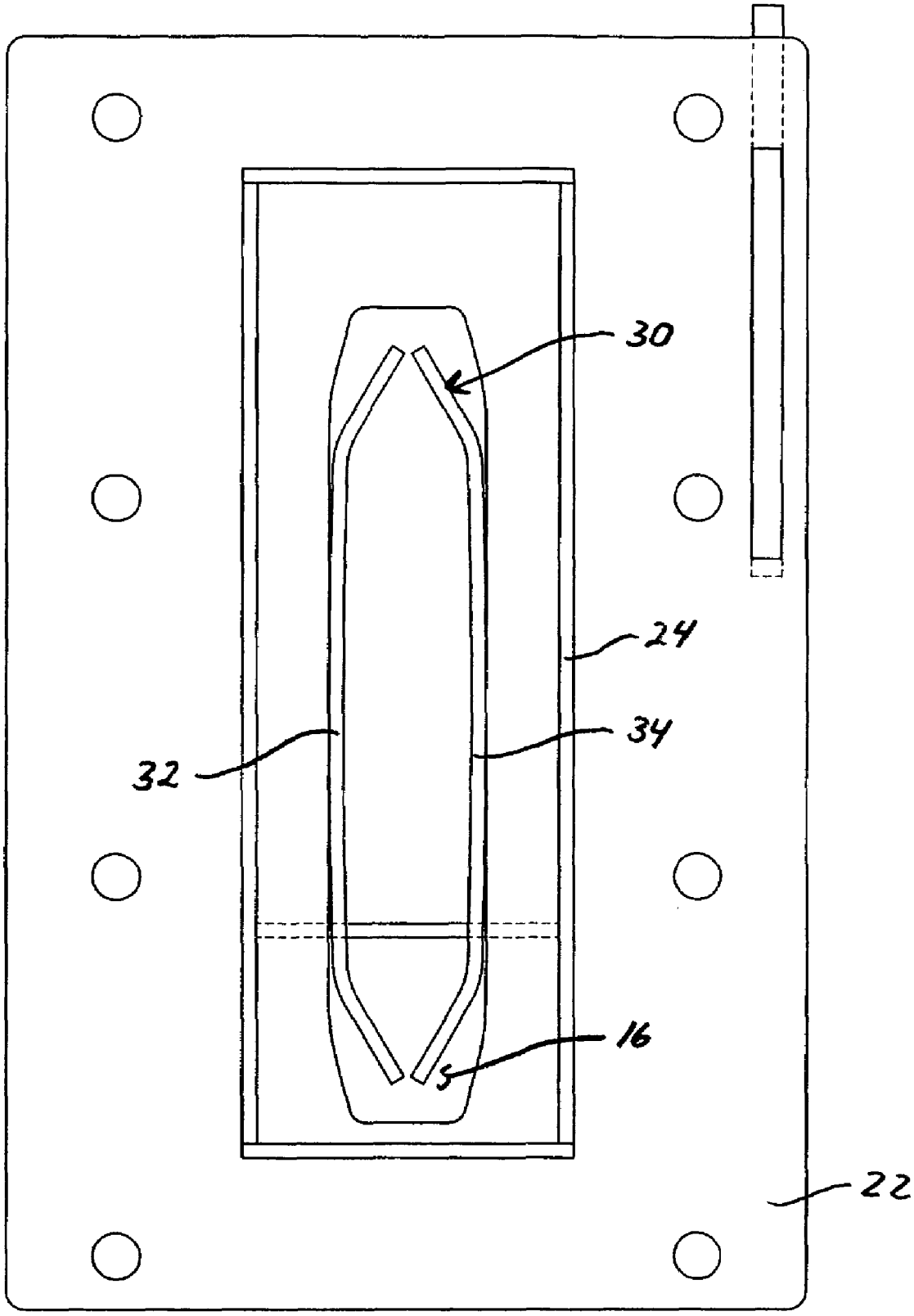
FIG. 5 is an end view taken in the direction of lines 5 of FIG. 1.

A cutting head 30 is mounted within the duct 24 and includes a pair of cutting plates 32 and 34, best shown in FIG. 4, which are shaped to closely approximate the inside surface shape of the air port 16. The cutting plates 32 and 34 form elongated attachment legs 36 and 38, as shown in FIGS. 1 and 3, which are connected to an actuator rod 40. The actuator rod 40 is connected to an actuator 42. The actuator 42 can be a fluid cylinder which may be operated pneumatically or by hydraulic fluid, or by other means. The actuator 42 causes the cutting head 30 to selectively move between a retracted position, as shown in solid lines in FIG. 1, and an extended position, as shown by the phantom lines in FIG. 1. In the retracted position, the cutting head 30 is positioned within the duct 24 and wind box 18. In the extended position, the cutting head 30 projects through the air port 16 in the boiler wall 12 into the interior of the recovery boiler. When the actuator 42 extends the cutting head 30 to the extended position, the cutting plates 32 and 34 pass through the air port 16 and clean fouling deposits which may collect and obstruct air flow through the air port 16. The cutting plates 32 and 34, along with their associated legs 36 and 38, provide a minimal obstruction to air flow through duct 24.

A wing 44 is pivotally mounted within the duct 24. The wing 44 is an elongated paddle-shaped member, preferably made of sheet metal. The wing 44 is mounted for pivotal rotation about a pivot pin 46 and acts as a damper. The wing 44 is capable of being moved through an angular range of motion between a fully opened position and a closed position. The fully opened position is shown in FIG. 1 in solid lines, and the closed position is shown in phantom lines. In the fully opened position, the wing 44 is pressed against an upper surface of the duct 24. Air is admitted into the duct 24 through the air inlet opening 28 and interacts with the inside surfaces of duct 24 and the wing 44. The gap "G" designated in FIG. 1 formed between a distal end 48 of the wing 44 and the bottom surface of the duct 24, determines an adjustable flow area for air flow through the duct 24 and into the air port 16 and thereby into the boiler. Dimension G is shown for the wing 44 in the closed position (providing a minimal flow area) shown in phantom lines. As can be seen, the gap "G" between the distal end 48 of the wing 44 and the bottom surface of the duct is much larger when the wing 44 is in the fully opened position, thereby providing a larger cross-sectional flow area thereby allowing greater air flow through the duct 24.

The wing 44 is pivotally mounted onto the pivot pin 46 and the pivot pin 46 is positioned outside the wind box 18. This allows the wing 44 to be longer. The longer the wing 44 is, the more laminar the flow of air through the duct 24 will be. Also, by placing the pivot pin 46 outside the wind box 18, the pivot pin 46 is easily accessible for maintenance and is positioned outside the high temperature interior of the wind box 18.

The sliding movement of the cutting head 30 is independent of the pivotal movement of the wing 44, and the wing 44 is shaped such that the cutting head 30 can be extended and retracted when the wing 44 is in any position without interference.

The adjustment of the angular position of the wing 44 is achieved through an actuator 50. As shown in FIG. 1, the actuator 50 is a manually operated lever. A set screw 52 within an arcuate slot 54 enables the position of the operating lever 50, and consequently the wing 44, to be set as desired and locked into position by clamping the set screw 52. Numerous other actuating or operating mechanisms for adjusting the position of the wing 44 are within the scope of this invention, including remotely controlled, hydraulic, electrical, pneumatic, and other forms of actuators which could set the angular position of the wing 44 to the desired point. An example of such a remotely controllable actuator for wing 44 is provided later in this description.

As illustrated in FIG. 1, air flowing in through the air inlet opening 28, as designated by arrow 55, encounters the wing 44 and accelerates as the cross-sectional flow area smoothly decreases in moving from the air inlet opening 28 to the distal end 48 of the wing 44. The cooperation between the inside surfaces of the duct 24 and the wing 44 provides a streamlined flow path which produces a jet of air through the air port 16 which is able to penetrate deeply within the boiler.

It has been found that the shape of the wing 44 can influence the performance of the air flow. Specifically, it has been found that having some bend in the shape of the wing 44 is beneficial in some applications. As illustrated in FIG. 1, the wing 44 is generally arcuate along its length. Other configurations are within the scope of this invention. For example, the wing 44 could feature a paraboloid configuration.

Figure 6:
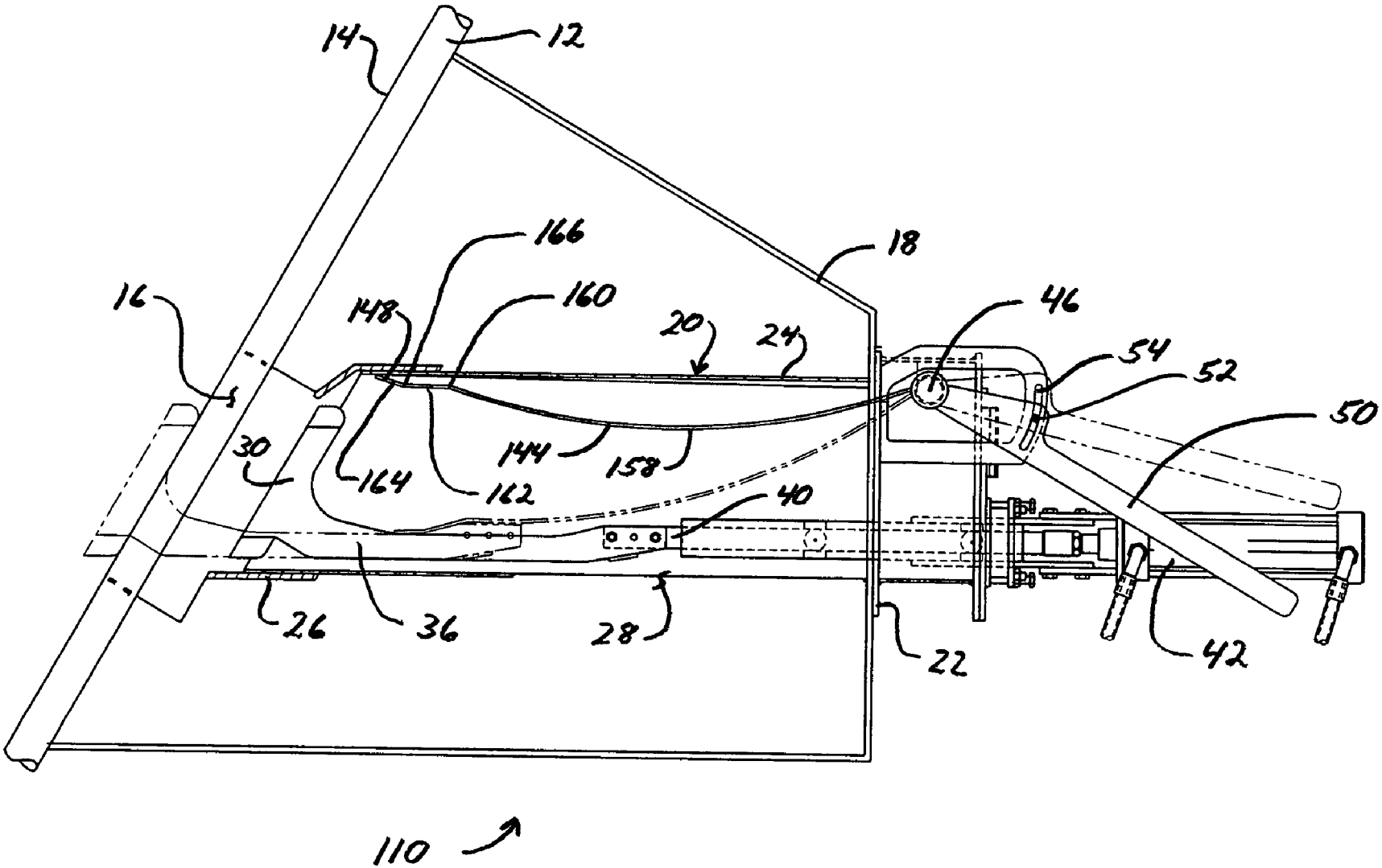
FIG. 6 is a side cut-away view of the port rodder assembly in accordance with a second embodiment of this invention illustrating a modified wing configuration.

Referring to FIG. 6, another embodiment of the present invention is shown generally at 110. Elements of this embodiment (and later described embodiments) which are equivalent to those previously described are identified by like reference numbers. Reference to the prior description of these elements will describe them as used in this embodiment. The port rodder assembly 110 differs from the previously described port rodder assembly 10 with regard to the shape of the wing 144. In this case, the wing 144 features a first arcuate bend 158 which extends from the pivot pin 46 to a position adjacent to, but short of the distal end 148 of the wing 144. The arcuate bend 158 ends at a break line 160 and transitions to two planar segments 162 and 164 separated by another break line 166. The modified configuration of the wing 144 in this embodiment may provide advantages in the control of air flowing into the boiler for certain applications.

Figure 7:
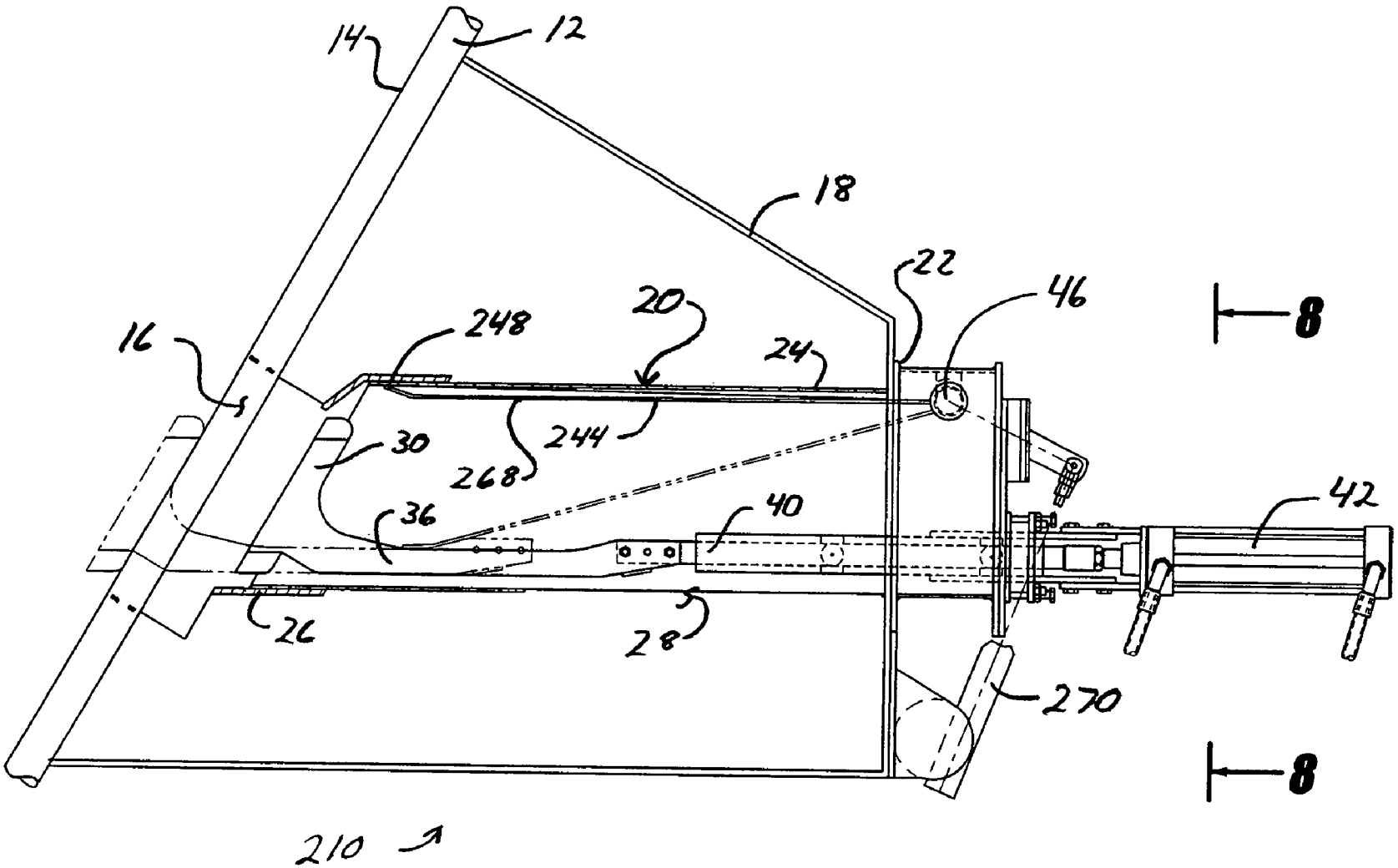
FIG. 7 is a side cut-away view of a port rodder assembly in accordance with a second embodiment of the this invention showing a mechanized actuation mechanism for adjusting the position of the wing.

Referring to FIG. 7, yet another embodiment of the present invention is shown generally at 210. This embodiment 210 differs in two principal respects from the prior embodiments 10 and 110. First, in this instance, the wing 244 is substantial planar in shape, and includes a lip formed by a planar segment 268 at the distal end 248 of the wing 244. As in the case of the prior embodiments 10, 110, this embodiment 210 is configured for particular applications and to provide a desired interaction with the interior surfaces of the duct 24 to provide the desired air flow characteristics. Additionally, the port rodder assembly 210 shown in FIG. 7 includes a powered actuator 270 which may be electrically or fluid operated or by other means to provide remote adjustment of the angle of the wing 244 (or the other wings 44 and 144).

Figure 8:
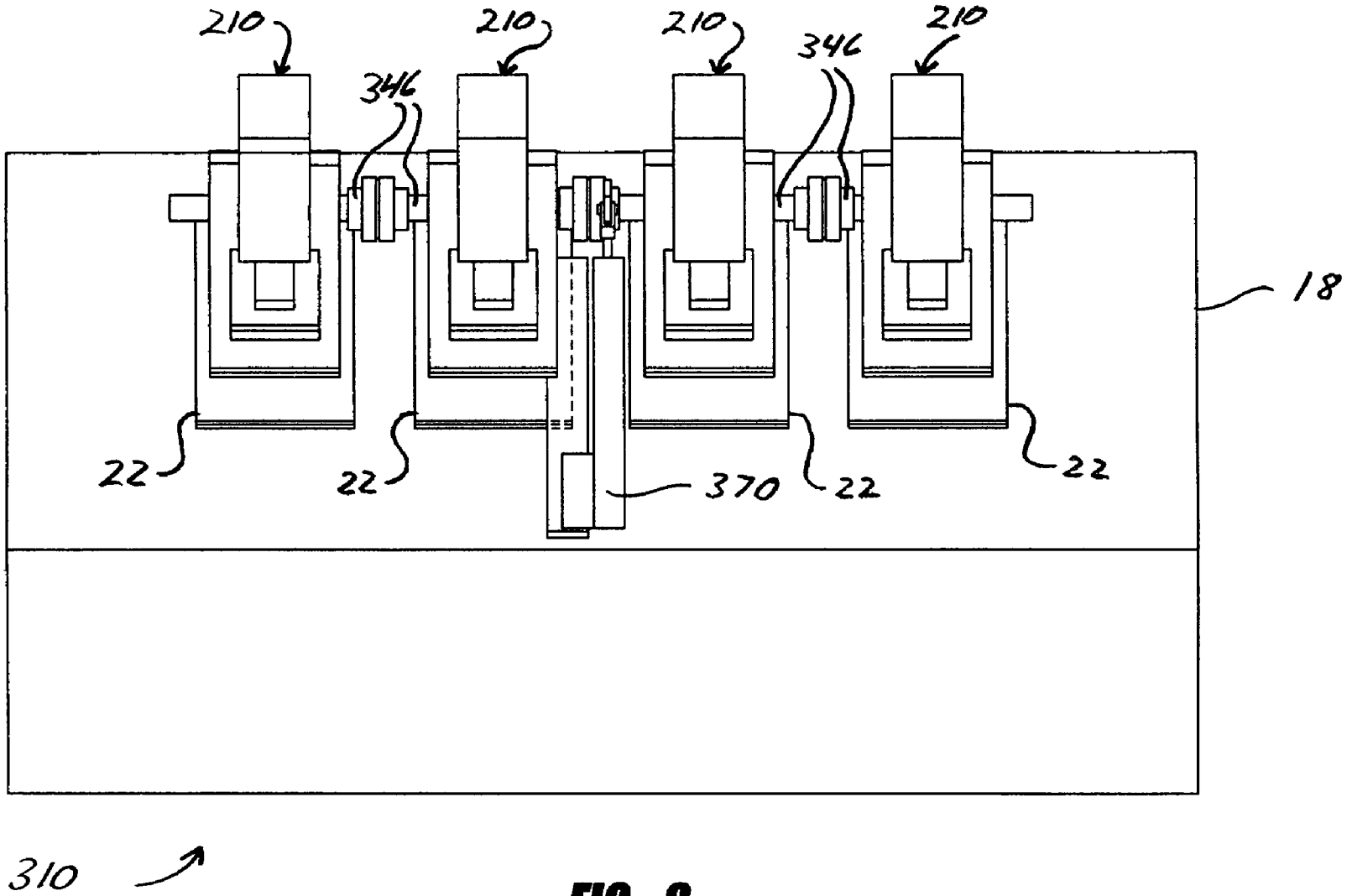
FIG. 8 is an end view of an array of port rodder assemblies in accordance with this invention.

FIG. 8 illustrates a multi-port rodder assembly 310 that is made up of a plurality of port rodder assemblies of any of the previously described embodiments that work cooperatively to clean and control the air flow to a plurality of air ports 16. The pivot pins 346 of the wings (not shown) are connected to one another such that a single actuator 370 can simultaneously adjust all of the wings (not shown) in unison.

While the above description constitutes the preferred embodiment of the present invention, it will be appreciated that the invention is susceptible to modification, variation and change without departing from the proper scope and fair meaning of the accompanying claims.

What is claimed is:

1. A port rodder assembly for a recovery boiler comprising:

a wind box connected to an exterior surface of the recovery boiler;

a duct positioned within the wind box, the duct affixed to and in fluid communication with an air port of the boiler, the duct having a hollow interior and an air inlet opening;

a cutting head slidably mounted within the duct adjacent to the air port, the cutting head adapted to clean the air port;

an actuator adapted to selectively advance the cutting head though the air port to clean the air port, and a wing pivotally mounted with respect to the duct, the wing interacting with the air inlet opening to define a cross-sectional flow area through the duct, whereby pivotal movement of the wing between a fully opened position and a closed position changes the size of the cross-sectional flow area to control the flow of air through the duct and into the air port, the wing being shaped such that the cross-sectional flow area smoothly decreases as incoming air flows through the duct to the air port when the wing is in the closed position;

wherein the cutting head is adapted to be slidably moveable independent of the wing such that the cutting head can be advanced or retracted with the wing in any position without interfering with the wing.

2. The port rodder assembly of claim 1, the wing being shaped such that when in the fully open position the wing closely conforms with an inside surface of the duct.

3. The port rodder assembly of claim 2 wherein the wing is infinitely adjustable between the fully opened position and the closed position.

4. The port rodder assembly of claim 3 further including a wing actuator adapted to move the wing between the fully opened position and the closed position and to selectively lock the wing in any position therebetween.

5. The port rodder assembly of claim 1 wherein the wing is generally planar shaped.

6. The port rodder assembly of claim 1 wherein the wing is generally arcuate shaped.

7. The port rodder assembly of claim 1 wherein the wing includes a distal end having a lip formed thereon.

8. The port rodder assembly of claim 1 further including an adapter to connect the duct to the air port.

9. The port rodder assembly of claim 1 wherein the duct, the cutting head and the wing are part of a cassette assembly and the cassette assembly is removable positioned within the wind box and is removable therefrom as a unit.

10. The port rodder assembly of claim 9 wherein when the cassette assembly is mounted within the wind box air flows into the air inlet from the interior of the wind box, and the wing is pivotally mounted onto a pivot pin, the pivot pin being positioned outside the wind box.

11. The port rodder assembly of claim 9 further including an adapter to connect the duct to the air port.

12. The port rodder assembly of claim 1, the wing pivotally mounted about a pivot pin positioned outside of the wind box such that the wing is accessible from an exterior of the wind box.

13. A multi-port rodder assembly for a recovery boiler comprising:

a wind box mounted to an exterior wall of the boiler and enclosing a plurality of air ports formed within the wall of the boiler;

a plurality of ducts positioned within the wind box, one duct being affixed to and in fluid communication with each air port of the boiler, each duct having a hollow interior and an air inlet opening;

a plurality of cutting heads, one cutting head slidably mounted within each of the ducts adjacent to the air ports, the cutting heads adapted to clean the air ports;

a plurality of actuators adapted to selectively advance the cutting heads though the air ports to clean the air ports, a plurality of wings, one wing pivotally mounted with respect to each duct, the wings interacting with the air inlet openings to control the flow of air through the ducts and into the air ports, the wings being shaped such that incoming air flows through the ducts to the air ports, each wing being mounted onto a pivot pin that is positioned outside of the wind box; and a wing actuator adapted to pivot all the wings, in unison, between a fully opened position and a closed position and to selectively lock the wings in any position therebetween;

wherein the cutting heads are adapted to be slidably moveable independent of the wings such that the cutting heads can be advanced or retracted with the wings in any position.

14. The multi-port rodder assembly of claim 13 wherein the wings are shaped such that when in the fully open position the wings closely conform with an inside surface of the ducts, and in the closed position, the wings interact with the ducts to create a flow path having a smoothly decreasing cross-sectional flow area for air flowing from the air inlets through the ducts and into the air ports.

15. The multi-port rodder assembly of claim 14 wherein the wings are infinitely adjustable between the fully opened position and the closed position.

16. The multi-port rodder assembly of claim 13 wherein the wings are generally planar shaped.

17. The multi-port rodder assembly of claim 13 wherein the wings are generally arcuate shaped.

18. The multi-port rodder assembly of claim 13 wherein the wings include a distal end having a lip formed thereon.

19. The multi-port rodder assembly of claim 13 further including a plurality of adapters to connect the ducts to the air ports.

20. A port rodder assembly for a recovery boiler comprising:

a wind box attached to an exterior wall of the boiler and enclosing an air port of the boiler;

a duct mounted within the wind box, the duct affixed to and in fluid communication with the air port of the boiler, the duct having a hollow interior and an air inlet opening to allow air to flow into the duct from the interior of the wind box;

a cutting head slidably mounted within the duct adjacent to the air port, the cutting head adapted to clean the air port;

an actuator adapted to selectively advance the cutting head though the air port to clean the air port, a wing pivotally mounted with respect to the duct, the wing interacting with the air inlet opening to control the flow of air through the duct and into the air port, the wing being infinitely adjustable between a fully opened position and a closed position and being shaped such that when in the fully open position the wing conforms with an inside surface of the duct, and in the closed position the wing interacts with the duct to define a smoothly decreasing cross-sectional flow area for air flowing from the air inlet, through the duct, and into the air port; and a wing actuator adapted to move the wing between the fully opened position and the closed position and to selectively lock the wing in any position therebetween;

the cutting head being slidably moveable independent of the wing such that the cutting head can be advanced or retracted with the wing in any position.

* * * * *

UNITED STATES PATENT AND TRADEMARK OFFICE

CERTIFICATE OF CORRECTION

PATENT NO. : 7,392,751 B2
APPLICATION NO. : 11/138574
DATED : July 1, 2008
INVENTOR(S) : Leif Bergmyren It is certified that error appears in the above-identified patent and that said Letters Patent is hereby corrected as shown below:

IN THE ABSTRACT; TITLE PAGE; ITEM (57)

In line 6, after “head”, delete “though” and insert --through--.

IN THE CLAIMS

In Claim 1, column 5, line 8, delete “though” and insert --through--.

In Claim 13, column 6, line 2, delete “though” and insert --through--.

In Claim 20, column 6, line 49, delete “though” and insert --through--.

Signed and Sealed this

Eleventh Day of November, 2008

JON W. DUDAS
*Director of the United States Patent and Trademark Office*